US006837575B2

(12) United States Patent
Usui

(10) Patent No.: US 6,837,575 B2
(45) Date of Patent: Jan. 4, 2005

(54) INK FEED UNIT FOR INK JET RECORDER AND DIAPHRAGM VALVE

(75) Inventor: Minoru Usui, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/070,381

(22) PCT Filed: Jun. 22, 2001

(86) PCT No.: PCT/JP01/05344

§ 371 (c)(1),
(2), (4) Date: Mar. 6, 2002

(87) PCT Pub. No.: WO02/04217

PCT Pub. Date: Jan. 17, 2002

(65) Prior Publication Data

US 2002/0135646 A1 Sep. 26, 2002

(30) Foreign Application Priority Data

Jul. 7, 2000 (JP) ..... P 2000-205990

(51) Int. Cl.[7] ..... B41J 2/175
(52) U.S. Cl. ..... 347/85
(58) Field of Search ..... 347/30, 84, 85, 347/86, 87; 137/859; 92/98 R

(56) References Cited

U.S. PATENT DOCUMENTS

| | | | | |
|---|---|---|---|---|
| 4,514,742 A | | 4/1985 | Suga et al. | |
| 4,817,503 A | * | 4/1989 | Yamada | 92/98 R |
| 4,882,596 A | * | 11/1989 | Tsuzuki et al. | 347/85 |
| 6,000,788 A | * | 12/1999 | Iida | 347/86 |
| 6,010,211 A | * | 1/2000 | Betschon | 347/86 |
| 6,220,690 B1 | * | 4/2001 | Wachi | 347/30 |
| 6,394,137 B1 | * | 5/2002 | Kikuchi et al. | 137/859 |
| 6,585,358 B2 | * | 7/2003 | Usui et al. | 347/85 |

FOREIGN PATENT DOCUMENTS

| | | |
|---|---|---|
| EP | 0 965 780 A1 | 12/1999 |
| EP | 1 270 235 A1 | 1/2003 |
| GB | 2 323 332 A | 9/1998 |
| JP | 8-200525 | 8/1996 |
| JP | 11-170558 | 6/1999 |
| JP | 2000-2346 | 1/2000 |
| WO | WO 01/78988 A1 | 10/2001 |

* cited by examiner

*Primary Examiner*—Anh T. N. Vo
(74) *Attorney, Agent, or Firm*—Sughrue Mion, PLLC

(57) ABSTRACT

An angled portion that is concentric with respect to an ink passing port (4) is formed in a central region (7) of a membrane portion (2) to function as an elasticity providing portion, whereby the influence produced when a thick portion is injection molded at the periphery is removed from affecting elasticity of a membrane valve.

22 Claims, 6 Drawing Sheets

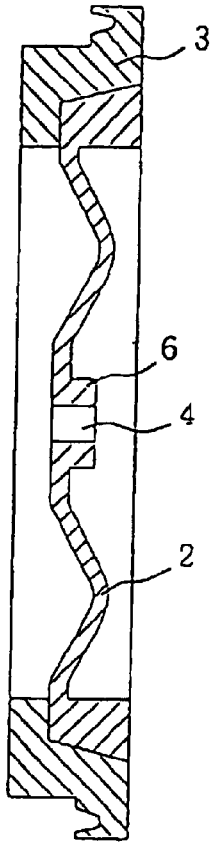
Fig.3
Fig. 4
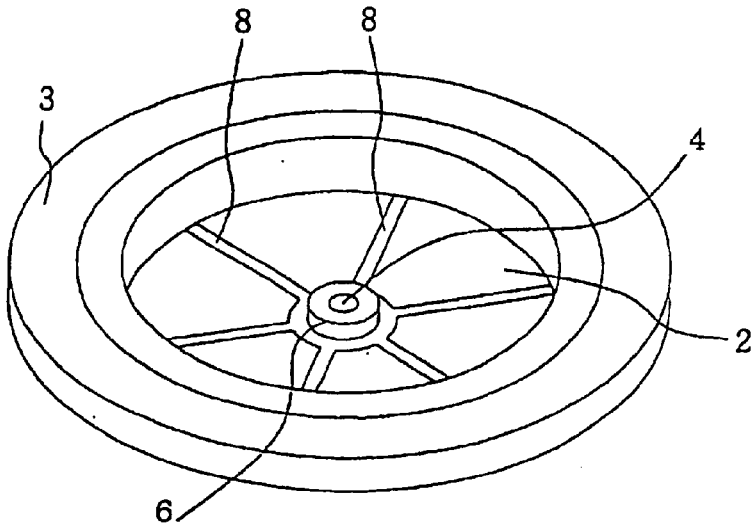

INK FEED UNIT FOR INK JET RECORDER AND DIAPHRAGM VALVE

TECHNICAL FIELD

The present invention relates to an ink supply unit that supplies ink in an ink cartridge to an ink jet recording head in a state where a constant negative pressure is applied onto the ink.

BACKGROUND ART

An ink jet recording apparatus used in a large number of printers adopts such an ink supply structure that an ink cartridge such as a cassette is put in a casing member, the ink cartridge is connected through an ink supply tube to an ink supply unit mounted on a carriage, and ink consumed in printing is supplied to a recording head through the ink supply unit including a differential pressure valve mechanism comprising a membrane valve.

By adopting this structure, according to the amount of ink consumption in the recording head, ink can be supplied to the recording head by opening and closing of the membrane valve.

However, it is very difficult to constitute the membrane valve that can correspond to the very small change of pressure produced by the ink consumption in the recording head, and does not open or close uselessly according to the vibration with a recording operation.

In order to solve such a problem, a membrane valve has been proposed as disclosed in Japanese Patent Laid-Open No. 2000-2346, which is a fluid supplying membrane valve in which a bending portion having a substantially crank-shaped section is formed in the vicinity of the periphery of a disc-shaped membrane valve having an ink supplying through-hole in its center.

According to this membrane valve, the through-hole can be brought into contact with or separated from a valve seat correspondingly to the very small differential pressure using the bending portion. However, since it is necessary for this membrane valve to simultaneously form a frame portion having a large section which functions as a support portion at its periphery, there is a disadvantage in that it is necessary to be skilled in constituting at a high accuracy the bending portion that affects elasticity of the membrane valve greatly.

Accordingly, an object of the invention is to provide an ink supply unit having a membrane valve that can be easily manufactured and can keep a valve closing state stable while it is corresponding to the very small differential pressure.

Another object of the invention is to provide the above-mentioned membrane valve.

DISCLOSURE OF THE INVENTION

According to the invention, in an ink supply unit for an ink jet recording apparatus having a membrane valve which includes at its periphery a thick portion supported by a valve seat constituting member and a thin portion having an ink passing port in a center, which is pressed at the vicinity of the periphery of the ink passing port against a valve seat by an elasticity applying means, and which comes into contact with or separates from the valve seat correspondingly to a differential pressure of ink, an angled portion that is concentric with respect to the ink passing port is formed in the central region of the thin portion of the membrane valve.

Hereby, the influence produced when the thick portion is injection molded at the periphery is removed, and the membrane valve can keep its posture stable in relation to the external force while it is corresponding to the very small differential pressure, so that there is an effect in which an ink supply unit that supplies ink to a recording head while it is maintaining the proper negative pressure can be readily manufactured.

Further, since a recess portion for bending does not exit around the membrane portion and the shape of the membrane valve is smooth as a whole, air bubbles do not stay, so that there is an effect in which the ink can be stably supplied to the recording head.

BRIEF DESCRIPTION OF THE DRAWINGS

FIGS. 3 and 4 are sectional views that show respectively other embodiments of the membrane valve used in the ink supplying unit of the invention;

BEST MODE FOR CARRYING OUT THE INVENTION

The invention will be described below in detail with reference to the shown embodiments.

Figure 1:
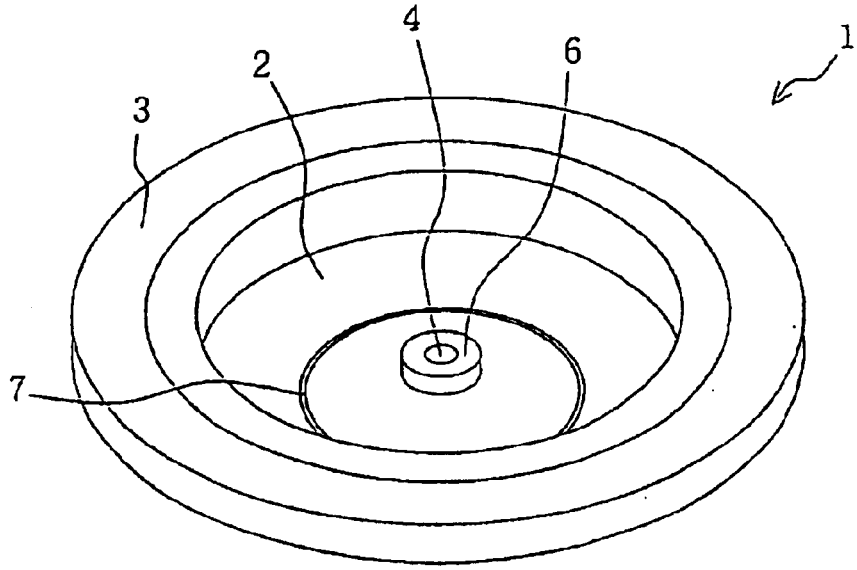
FIG. 1 is a perspective view showing one embodiment of a membrane valve of the invention.

FIG. 1 shows one embodiment of a membrane valve of the invention, and FIG. 2 shows a valve closing state and a valve opening state in case where this membrane valve is built in a differential pressure valve mechanism. A membrane valve 1 constituted as a movable membrane comprises a membrane portion 2 which is formed of soft material that can deform elastically upon reception of the differential pressure, and a thick frame portion 3 which is formed of hard material that supports the periphery of the membrane portion 2 and is clamped and held by a fixing member such as a casing, which are integrally manufactured preferably by two color molding of a polymer.

In the membrane portion 2, an ink passing port 4 is formed in its center, a region 5 opposed to a valve seat is formed as an approximately flat surface, and a spring receiving protrusion 6 having a circular section is formed on the other surface. Further, the membrane portion 2 is angled substantially in a shape of V at a central region 7 so as to be concentric with respect to the ink passing port 4.

Figure 2A:
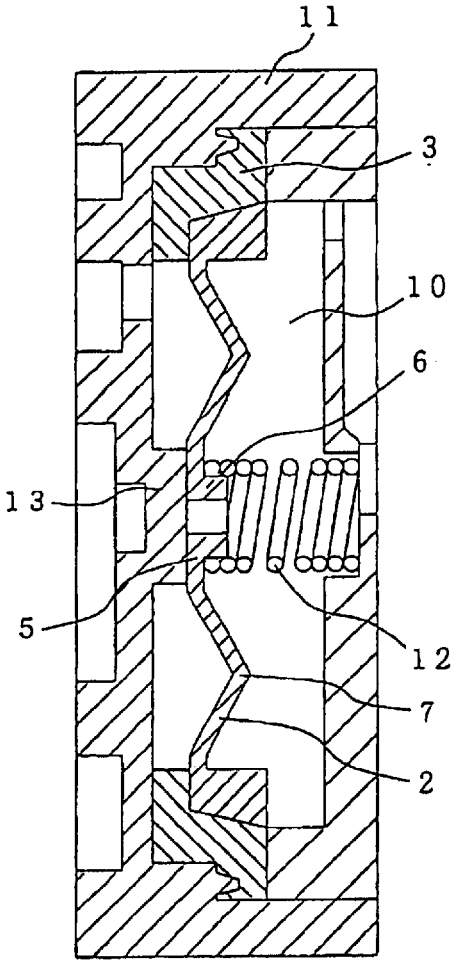
FIGS. 2A and 2B are sectional views that show respectively a valve closing state and a valve opening state incase that a differential pressure valve mechanism of an ink supply unit is constituted by the membrane valve.

In the thus constructed membrane valve 1, the frame portion 3 is fixed to a support portion of a member 11 constituting a valve chamber 10 and defining a window having a circular section, and one end of a coil spring 12 is inserted onto the spring receiving protrusion 6, whereby the membrane valve 1 is built into the differential pressure valve mechanism. In the state where the differential pressure does not act on the membrane valve 1, as shown in FIG. 2A, the region 5 is elastically pressed against a valve seat 13 by the coil spring 12 to thereby shut a flowing passage.

Figure 2B:
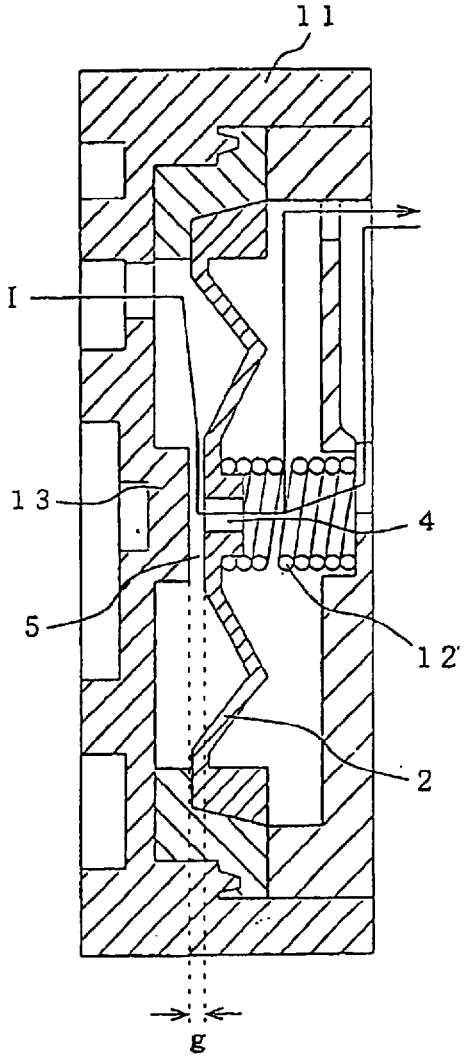

On the other hand, when the pressure on the downstream side of the membrane valve 1 becomes lower than the pressure on the upstream side and a predetermined differential pressure acts on the membrane valve 1, as shown in FIG. 2B, the membrane portion 2 moves against the spring 12 toward the spring 12 to thereby form a gap g between the region 5 and the valve seat 13. Accordingly, ink I flows through the ink passing port 4 into the recording head. When the ink flows into the recording read and the differential pressure between the upstream side of the membrane valve 1 and the downstream side thereof becomes small, the membrane portion 2 is pressed by the coil spring 2 and comes into contact the valve seat 13 to thereby shut the flowing passage.

The reciprocating movement of a carriage during a printing period causes vibration on the whole of the recording apparatus and this vibration acts on the membrane valve 1. Since the membrane portion 2 exhibits the elasticity at its central region 7 under this state, there is no influence produced when the peripheral thick portion is injection molded, and the membrane valve can keep its posture as stable as possible to thereby keep the valve closing state.

In the embodiment, the angled portion is bent in its section approximately in the shape of [v]. However, also in case that the angled portion is bent approximately in the shape of [U] as shown in FIG. 3, the same effect is obtained.

FIG. 4 shows another embodiment of the invention. In this embodiment, a membrane portion 2' of a membrane valve 1 is formed as an approximately flat surface, and protruding rib portions 8 radially extending to the periphery from a spring receiving protrusion 6 and located at regular intervals are formed on at least one surface of the membrane portion 2'.

According to this embodiment, the membrane portion 2 is formed as thin as possible to thereby reduce rigidity, while each of the protruding rib portions 8 functions as a reinforcement member, whereby the whole posture of the membrane portion 2 can be kept constant. Further, by forming recess groove portions in a metal mold for forming the membrane portion, the protruding rib portions 8 can be formed simultaneously with the formation of the membrane portion.

Figure 5:
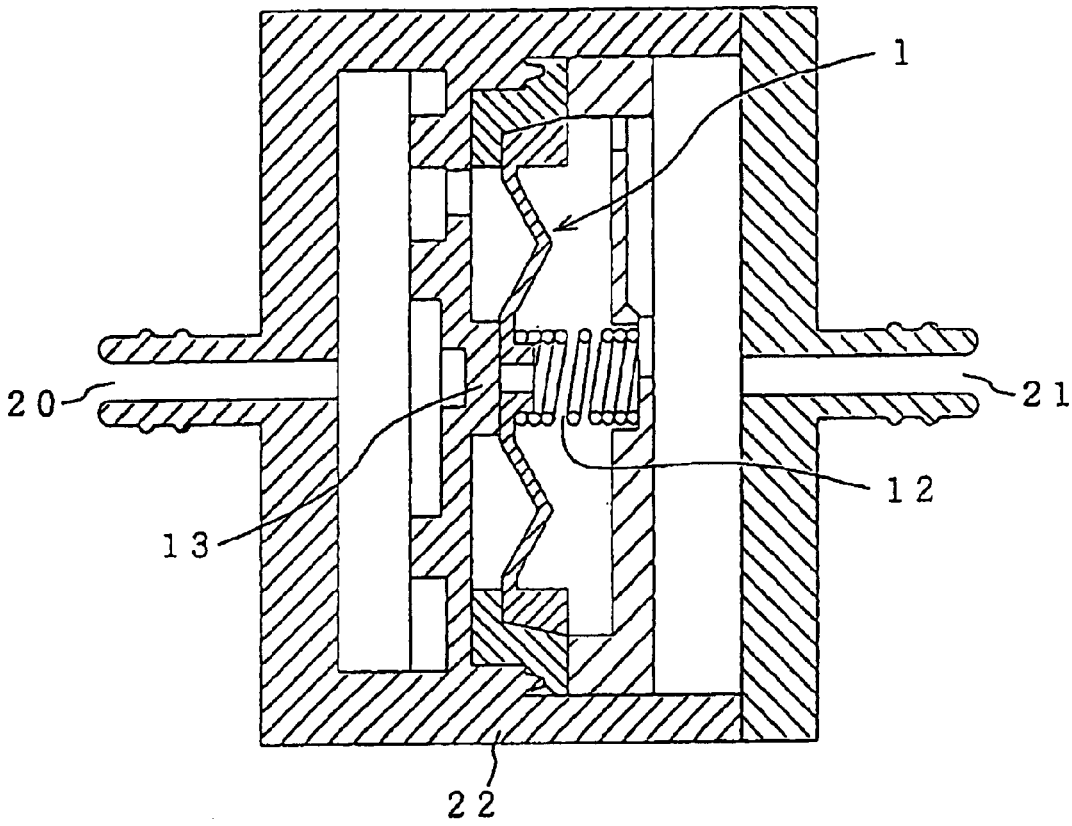
FIG. 5 is a diagram showing one embodiment in case that the ink supplying unit is constituted by the membrane valve.

The thus constructed membrane valve 1 is, as shown in FIG. 5, arranged in a container 22 in which an ink inlet 20 connected to an ink cartridge is formed on one side and an ink outlet 21 connected to the recording head is formed on the other side, so as to partition these ink inlet 20 and ink outlet 21, to thereby constitute the ink supply unit. And, the ink inlet 20 is connected to the ink cartridge by a passage forming member such as a tube and the ink outlet 21 is connected to the recording head by a passage forming member such as a tube, whereby an ink supply system can be constituted.

According to this ink supply system, regardless of ink level in the ink cartridge and a difference in height between the ink cartridge and the recording head, the ink supplying pressure to the recording head can be kept approximately constant by the membrane valve 1.

In the embodiment, the membrane valve is assembled into the ink supply unit constituted as a separate unit. However, as shown in FIGS. 6 and 7, the membrane valve may be assembled into the ink cartridge or a sub-tank connected to the recording head to form the ink supply unit.

Figure 6:
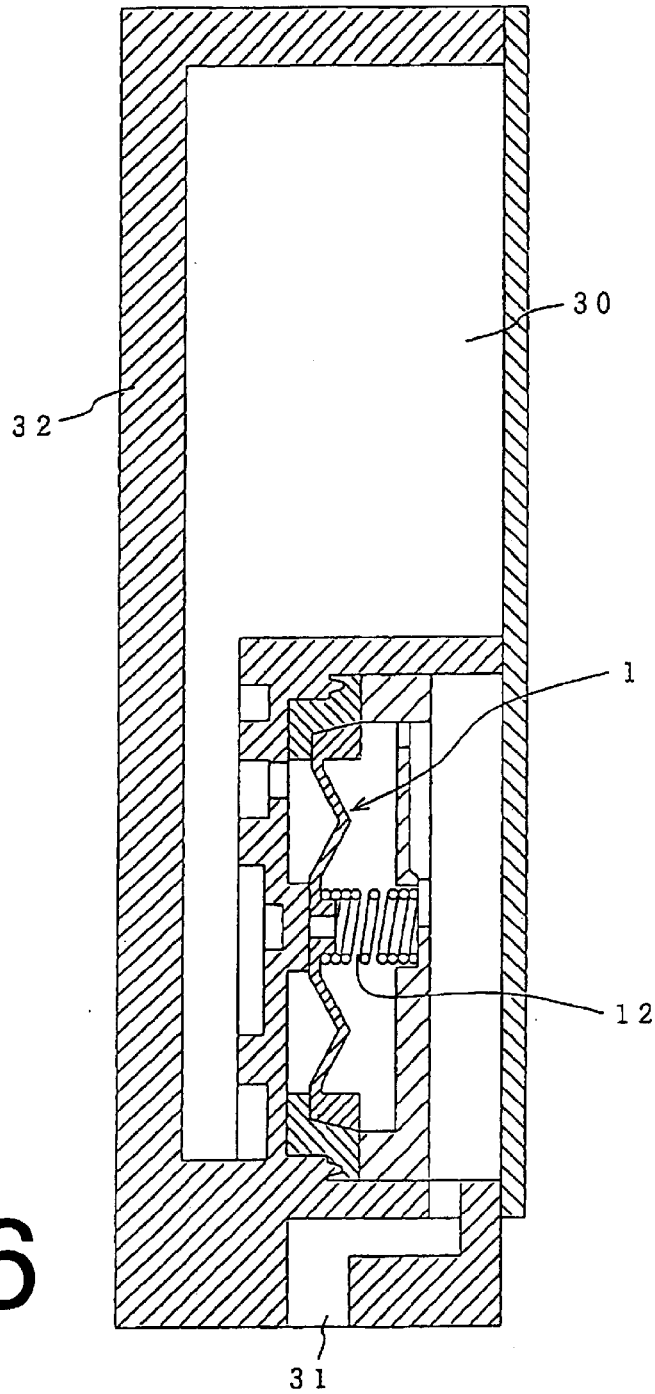
FIGS. 6 and 7 are diagrams respectively showing examples in case that the membrane valve is applied to other ink supply systems.

Namely, as shown in FIG. 6, in a container 32 including an ink storage portion 30 and an ink outlet 31, the membrane valve 1 is stored so that the moving side of the membrane valve 1 at the valve opening time (right side in FIG. 6) is separated from the ink storage portion 30 and communicates with the ink outlet 31, whereby an ink cartridge into which the membrane valve 1 is assembled can constituted.

Figure 7:
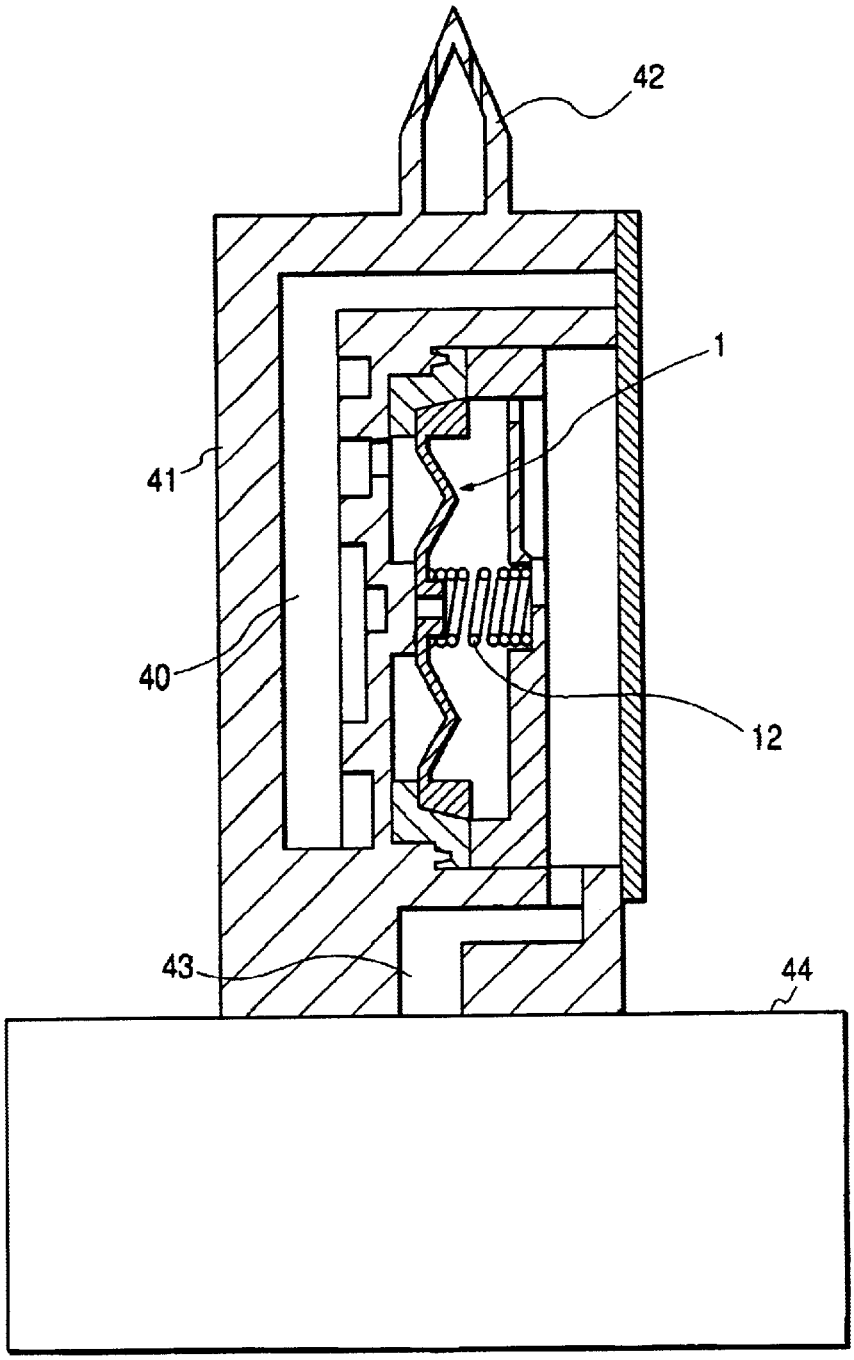

Further, as shown in FIG. 7, also in case that a connection member 42 that connects to an ink cartridge detachably is provided for a container 41 having an ink storage chamber 40, a membrane valve 1 is stored so as to separate from the ink storage 40, a fluid passage 43 is formed so as to communicate with the downstream side of the membrane valve 1, and a recording head 44 is provided through the fluid passage 43, the same effect can be obtained.

In the embodiment, the spring receiving protrusion 6 is formed in the vicinity of the ink passing port 4 of the membrane valve 1, and the coil spring 12 is brought into contact with this protrusion 6 to thereby press the ink passing port 4 against the valve seat 13. However, the valve seat 13 may be arranged to urge and elastically deform the membrane valve 1, whereby the coil spring 12 functioning as an elasticity applying unit can be dispensed with.

Industrial Applicability

As described above, the apparatus according to the invention can be readily manufactured, and can keep the valve closing state stable while it is corresponding to the very small differential pressure, so that the ink supplying unit and the membrane valve that are suitable for the ink supply mechanism of the ink jet recording apparatus can be provided.

What is claimed is:

1. An ink supply unit for an ink jet recording apparatus, having:

a supporting member including a valve seat; and a membrane valve including:

a thick portion at a periphery of the membrane valve, a portion including an ink passing port in a center of the membrane valve, opposing the valve seat, and a thin membrane portion interconnecting the thick portion and the portion including the ink passing port, said thin membrane portion being concentric around the center of the membrane valve, wherein said thick portion of said membrane valve is supported by said supporting member, and said ink passing port of said membrane valve selectively contacting said valve seat, wherein when ink is provided to said membrane valve, said ink passing port comes into contact with or separates from the valve seat correspondingly to a differential pressure of ink across said membrane valve, and wherein the thin membrane portion of the membrane valve has an angled portion that is concentric with respect to the ink passing port.

2. The ink supply unit for an ink jet recording apparatus according to claim 1, further comprising elasticity applying means for pressing said ink passing port against said valve seat.

3. The ink supply unit for an ink jet recording apparatus according to claim 1, wherein a shape of said angled portion is selected from the group consisting of a "V" shape and a "U" shape.

4. The ink supply unit for an ink jet recording apparatus according to claim 1, wherein said portion including the ink passing port is thicker than said thin membrane portion.

5. The ink supply unit for an ink jet recording apparatus according to claim 1, wherein when said thin membrane portion elastically deforms upon reception of a differential pressure of ink across said membrane valve, said membrane valve maintains a stable posture.

6. The ink supply unit for an ink jet recording apparatus according to claim 1, wherein a shape of the thin portion of the membrane valve, including the angled portion, is smooth as a whole.

7. An ink supply unit for an ink jet recording apparatus, having:

a supporting member including a valve seat;

a membrane valve including:

a thick portion at a periphery of the membrane valve, a portion including an ink passing port in a center of the membrane valve, opposing the valve seat, and a thin membrane portion interconnecting the thick portion and the portion including the ink passing port, said thin membrane portion being concentric around the center of the membrane valve, wherein said thick portion of said membrane valve is supported by said supporting member, and said ink passing port of said membrane valve selectively contacting said valve seat, wherein when ink is provided to said membrane valve, said ink passing port comes into contact with or separates from the valve seat correspondingly to a differential pressure of ink across said membrane valve, and wherein the thin membrane portion of the membrane valve is formed as an approximately flat surface, having plural protruding rib portions radially extending from the portion including the ink passing port to the thick portion and located at regular intervals.

8. The ink supply unit for an ink jet recording apparatus according to claim 1 or 7, wherein the membrane valve is arranged in a flowing passage connecting an ink cartridge and an ink jet recording head.

9. The ink supply unit for an ink jet recording apparatus according to claim 1 or 7, wherein the membrane valve is arranged in an ink container detachably attached to a flowing passage for supplying ink to an ink jet recording head.

10. The ink supply unit for an ink jet recording apparatus according to claim 7, further comprising:

elasticity applying means for pressing the ink passing port against said valve seat.

11. The ink supply unit for an ink jet recording apparatus according to claim 2 or 10, wherein a vicinity of a periphery of the ink passing port is pressed against the valve seat by the elasticity applying means.

12. The ink supply unit for an ink jet recording apparatus according to claim 7, wherein said portion including the ink passing port is thicker than said thin membrane portion.

13. The ink supply unit for an ink jet recording apparatus according to claim 12, wherein an area of said thin membrane portion, including said plural protruding rib portions extending from the portion including the ink passing port to the thick portion, elastically deforms upon reception of a differential pressure of ink across said membrane valve, said area being radially inward of said thick portion supported by said supporting member.

14. The ink supply unit for an ink jet recording apparatus according to claim 7, wherein when said thin membrane portion elastically deforms upon reception of a differential pressure of ink across said membrane valve, said membrane valve maintains a stable posture.

15. The ink supply unit for an ink jet recording apparatus according to claim 7, wherein a shape of the thin portion of the membrane valve, including the angled portion, is smooth as a whole.

16. A membrane valve of an ink supply unit for an ink jet recording apparatus, comprising:

a thick portion at a periphery of said membrane valve, configured to be supported by a supporting member;

a portion including an ink passing port in a center of the the membrane valve, configured to selectively contact a valve seat of the supporting member; and a thin membrane portion interconnecting the thick portion and the portion including the ink passing port, said thin membrane portion being concentric around the center of the membrane valve, wherein when ink is provided to said membrane valve, said ink passing port comes into contact with or separates from the valve seat correspondingly to a differential pressure of ink across said membrane valve, and wherein the thin membrane portion has an angled portion that is concentric with respect to the ink passing port.

17. The membrane valve of an ink supply unit for an ink jet recording apparatus according to claim 16, wherein a shape of said angled portion is selected from the group consisting of a "V" shape and a "U" shape.

18. A membrane valve of an ink supply unit for an ink jet recording apparatus, comprising:

a thick portion at a periphery of said membrane valve, configured to be supported by a supporting member;

a portion including an ink passing port in a center of the the membrane valve, configured to selectively contact a valve seat of the supporting member; and a thin membrane portion interconnecting the thick portion and the portion including the ink passing port, said thin membrane portion being concentric around the center of the membrane valve, wherein when ink is provided to said membrane valve, said ink passing port comes into contact with or separates from the valve seat correspondingly to a differential pressure of ink across said membrane valve, and wherein the thin membrane portion is formed as an approximately flat surface, having plural protruding rib portions radially extending from the portion including the ink passing port to the thick portion and located at regular intervals.

19. The membrane valve of an ink supply unit for an ink jet recording apparatus according to claim 16 or 18, wherein the said portion including the ink passing port is configured to be a contact surface for elasticity applying means for pressing said ink passing port against the valve seat.

20. An ink supply unit for an ink jet recording apparatus, having:

a valve seat; and a membrane valve including:

a periphery portion at a periphery of the membrane valve, and a central portion having an ink passing port in a center at a central region of the membrane valve, wherein said periphery portion of said membrane valve is supported by a supporting member, and said ink passing port of said membrane valve selectively contacts said valve seat, wherein when ink is provided to said membrane valve, said ink passing port comes into contact with or separates from the valve seat correspondingly to a differential pressure of ink across said membrane valve, and wherein the central region of the central portion of the membrane valve has an angled portion that is concentric with respect to the ink passing port.

21. An ink supply unit for an ink jet recording apparatus, having:

a valve seat;

a membrane valve including:

a periphery portion at a periphery of the membrane valve, and a central portion having an ink passing port in a center at a central region of the membrane valve, wherein said periphery portion of said membrane valve is supported by a supporting member, and said ink passing port of said membrane valve selectively contacts said valve seat; and wherein when ink is provided to said membrane valve, said ink passing port comes into contact with or separates from the valve seat correspondingly to a differential pressure of ink across said membrane valve, and wherein the central portion of the membrane valve is formed as an approximately flat surface, having plural protruding rib portions radially extending from the ink passing port to the periphery portion and located at regular intervals.

22. The ink supply unit for an ink jet recording apparatus according to claim 21, further comprising:

elasticity applying means for pressing the ink passing port against said valve seat.

* * * * *